10/30/84 XR 4,479,999

United States Patent [19]

Buckley et al.

[11] Patent Number: 4,479,999

[45] Date of Patent: Oct. 30, 1984

[54] FABRIC COMPRISED OF FUSIBLE AND INFUSIBLE FIBERS, THE FORMER COMPRISING A POLYMER WHICH IS CAPABLE OF FORMING AN ANISOTROPIC MELT PHASE

[75] Inventors: Alan Buckley, Berkeley Heights; Paul E. McMahon, Chatham, both of N.J.

[73] Assignee: Celanese Corporation, New York, N.Y.

[21] Appl. No.: 368,491

[22] Filed: Apr. 15, 1982

[51] Int. Cl.[3] ..... B32B 27/12; B32B 27/36

[52] U.S. Cl. ..... 428/245; 428/229; 428/271; 428/272; 428/273; 428/288; 428/294; 428/296; 428/408; 428/481; 428/902

[58] Field of Search ..... 528/190; 428/288, 229, 428/272, 271, 273, 294, 296, 245, 481, 902, 408

[56] References Cited

U.S. PATENT DOCUMENTS

| | | | |
|---|---|---|---|
| 3,620,892 | 11/1971 | Winklhofer et al. | 428/197 |
| 3,975,487 | 8/1976 | Cottes et al. | 264/236 |
| 4,183,895 | 1/1980 | Luise | 528/191 |
| 4,362,777 | 12/1982 | Miller | 428/288 |
| 4,368,234 | 1/1983 | Palmer et al. | 428/245 |

FOREIGN PATENT DOCUMENTS

| | | |
|---|---|---|
| 1228573 | 4/1971 | United Kingdom . |

*Primary Examiner*—James C. Cannon

*Attorney, Agent, or Firm*—Burns, Doane, Swecker & Mathis

[57] ABSTRACT

An improved fabric is provided comprised of fusible and infusible fibers. The fusible fibers comprise thermotropic liquid crystal polymers (i.e., polymers which are capable of forming an anisotropic melt phase). When the liquid crystal fibers are heated, they fuse to adjacent infusible fibers without any substantial loss of the orientation which was imparted to the same during melt extrusion. A fabric of enhanced strength and stiffness is thus formed in comparison to a fabric which employs conventional thermoplastic polymers which do not form an anisotropic melt phase.

34 Claims, No Drawings

FABRIC COMPRISED OF FUSIBLE AND INFUSIBLE FIBERS, THE FORMER COMPRISING A POLYMER WHICH IS CAPABLE OF FORMING AN ANISOTROPIC MELT PHASE

CROSS-REFERENCE TO RELATED APPLICATIONS

This application is related to U.S. patent application Ser. No. 319,525, filed Nov. 9, 1981, of Alan Buckley and Gordon W. Calundann entitled "Non-Woven Articles Comprised of Thermotropic Liquid Crystal Polymer Fibers."

BACKGROUND OF THE INVENTION

The present invention relates to fabrics fabricated from infusible fibers and fusible fibers of thermotropic liquid crystal polymers.

Fabrics have been produced comprised of fusible and infusible fibers. The fusible fibers, typically comprised of thermoplastic polymeric materials, are initially woven together with the infusible fibers into a fabric, with the fabric subsequently being heat treated at a temperature above the melting point of the fusible fibers. The fusible fibers thus become thermally bonded to adjacent infusible fibers and, in effect, serve as a matrix therefore. See, for example, U.S. Pat. No. 3,620,892 and British Patent Nos. 1,228,573 and 1,260,409. Conventional thermoplastic materials possess certain disadvantages, however, in that the physical characteristics of the thermoplastic material (e.g., strength and polymer orientation within the fibers) are significantly lessened as a result of the thermal bonding of the fibers. It is therefore desirable to provide a fabric comprised of fusible and infusible materials wherein the fusible material retains its desirable physical characteristics subsequent to being heated above its melting temperature.

It is also known to those skilled in the art that the heat treatment of shaped articles of liquid crystal polymers increases the melting temperature, molecular weight and mechanical properties of the polymer. See, for example, U.S. Pat. Nos. 3,975,487; 4,183,895; and 4,247,514.

OBJECTS AND SUMMARY OF THE INVENTION

It is therefore an object of the present invention to provide a fabric containing fibers comprised of a thermoplastic polymer which polymer retains its desirable mechanical properties subsequent to heat treatment thereof at a temperature above the melting temperature of the polymer.

It is also an object of the present invention to provide a fabric containing both fusible and infusible fibers wherein the fusible fibers can be thermally bonded to the infusible fibers without loss of desirable mechanical properties.

It is also an object of the present invention to provide a fabric which exhibits desirable thermal stability and chemical and solvent resistance.

In accordance with the present invention there is thus provided a fabric which exhibits thermal stability and chemical and solvent resistance comprised of fusible and infusible fibers, said fusible fibers being thermally bonded to the infusible fibers and comprised of a polymer which is capable of forming an anisotropic melt phase.

DETAILED DESCRIPTION OF THE INVENTION

It has been found that thermotropic liquid crystal polymers are uniquely suited for use as fusible fibers in fabrics comprised of fusible and infusible fibers. Thermotropic liquid crystal polymers retain their anisotropic characteristics in the melt phase such that the polymers remain highly oriented. Fabrics comprised of thermotropic liquid crystal fibers retain residual strength characteristics subsequent to being subjected to heat treatment to fuse the thermotropic fibers to adjacent fibers.

For purposes of the present invention, fusible fibers are those fibers which can be reduced to a liquid state or melted without significant degradation of the polymer or loss of its properties upon resolidification. The fusible fibers are also comprised of a polymer which is capable of forming an anisotropic melt phase at a temperature which is preferably below about 600° C. and most preferably below about 400° C. Infusible fibers are those fibers which either (1) cannot be reduced to a liquid state, (2) can be reduced to a liquid state only with significant thermal and/or oxidative degradation, or (3) can only be reduced to a liquid state at a temperature in excess of about 700° C. For example, carbon fibers will sublime and/or erode by oxidation upon being subjected to excessive temperatures and are thus deemed to be infusible by character. In addition, glass fibers are deemed to be infusible for purposes of the present invention since they generally melt at a temperature in excess of about 700° C. Similarly, lyotropic liquid crystal polymers are deemed to be infusible since they are solution-processable and not melt-processable. An exemplary lyotropic liquid crystal polymer is poly(p-phenylene terephthalamide) marketed by DuPont under the tradename Kevlar.

Thermotropic liquid crystal polymers are polymers which are liquid crystalline (i.e., anisotropic) in the melt phase. These polymers have been described by various terms, including "liquid crystalline", "liquid crystal" and "anisotropic". Briefly, the polymers of this class are thought to involve a parallel ordering of the molecular chains. The state wherein the molecules are so ordered is often referred to either as the liquid crystal state or the nematic phase of the liquid crystalline material. These polymers are prepared from monomers which are generally long, flat and fairly rigid along the long axis of the molecule and commonly have chain-extending linkages that are either coaxial or parallel.

Such polymers readily form liquid crystals (i.e., exhibit anisotropic properties) in the melt phase. Such properties may be confirmed by conventional polarized light techniques whereby crossed polarizers are utilized. More specifically, the anisotropic melt phase may be confirmed by the use of a Leitz polarizing microscope at a magnification of 40× with the sample on a Leitz hot stage and under nitrogen atmosphere. The polymer is optically anisotropic; i.e., it transmits light when examined between crossed polarizers. Polarized light is transmitted when the sample is optically anisotropic even in the static state.

Thermotropic liquid crystal polymers include but are not limited to wholly and non-wholly aromatic polyesters, aromatic-aliphatic polyesters, aromatic polyazomethines, aromatic polyester-carbonates and aromatic and non-wholly aromatic polyester-amides.

The aromatic polyesters and poly(ester-amide)s are considered to be "wholly" aromatic in the sens that each moiety present in the polyester contributes at least one aromatic ring to the polymer backbone and which enable the polymer to exhibit anisotropic properties in the melt phase. Such moieties may be derived from aromatic diols, aromatic amines, aromatic diacids and aromatic hydroxy acids. Moieties which may be present in the thermotropic liquid crystal polymers employed in the present invention (wholly or non-wholly aromatic) include but are not limited to the following:

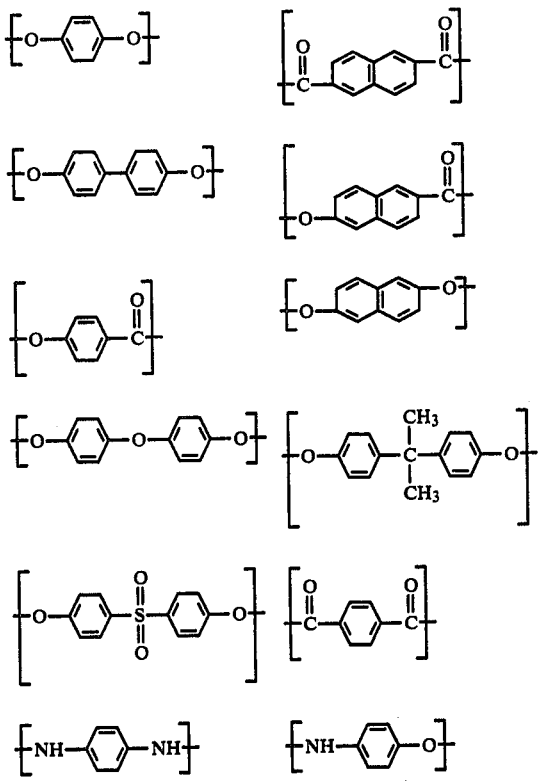

Preferably, the thermotropic liquid crystal polymers which are employed comprise not less than about 10 mole percent of recurring units which include a naphthalene moiety. Preferred naphthalene moieties include 6-oxy-2-naphthoyl, 2,6-dioxynaphthalene and 2,6-dicarboxynaphthalene.

Specific examples of suitable aromatic-aliphatic polyesters are copolymers of polyethylene terephthalate and hydroxybenzoic acid as disclosed in *Polyester X7G-A Self Reinforced Thermoplastic,* by W. J. Jackson, Jr., H. F. Kuhfuss, and T. F. Gray, Jr., 30th Anniversary Technical Conference, 1975 Reinforced Plastics/Composites Institute, The Society of the Plastics Industry, Inc., Section 17-D, Pages 1-4. A further disclosure of such copolymers can be found in "Liquid Crystal Polymers: I. Preparation and Properties of p-Hydroxybenzoic Acid Copolymers," *Journal of Polymer Science, Polymer Chemistry Edition,* Vol. 14, pp. 2043–58 (1976), by W. J. Jackson, Jr., and H. F. Kuhfuss. The above-cited references are herein incorporated by reference in their entirety.

Aromatic polyazomethines and processes of preparing the same are disclosed in the U.S. Pat. Nos. 3,493,522; 3,493,524; 3,503,739; 3,516,970; 3,516,971; 3,526,611; 4,048,148; and 4,122,070. Each of these patents is herein incorporated by reference in its entirety. Specific examples of such polymers include poly(nitrilo-2-methyl-1,4-phenylenenitriloethylidyne-1,4-phenyleneethylidyne); poly(nitrolo-2-methyl-1,4-phenylenenitrilomethylidyne-1,4-phenylenemethylidyne); and poly(nitrilo-2-chloro-1,4-phenylenenitrilomethylidyne-1,4-phenylenemethylidyne).

Aromatic polyester-carbonates are disclosed in U.S. Pat. No. 4,107,143 and 4,284,757, which are herein incorporated by reference in their entirety. Examples of such polymers include those consisting essentially of p-oxybenzoyl units, p-dioxyphenyl units, dioxycarbonyl units, and terephthoyl units.

Aromatic polyester-amides and processes of preparing the same are disclosed in the U.S. Pat. No. 4,182,842. Further disclosure of such copolymers can be found in "Liquid Crystal Polymers: III Preparation of Properties of Poly(Ester Amides) from p-Aminobenzoic Acid and Poly(Ethylene Terephthalate)," *Journal of Applied Polymer Science,* Vol. 25 pp. 1685–1694 (1980), by W. J. Jackson, Jr., and H. F. Kuhfuss. The above cited references are herein incorporated by reference in their entirety.

The liquid crystal polymers which are preferred for use in the present invention are the thermotropic wholly aromatic polyesters. Recent publications disclosing such polyesters include (a) Belgian Pat. Nos. 828,935 and 828,936, (b) Dutch Pat. No. 7505551, (c) West German Pat. Nos. 2,520,819, 2,520,820, and 2,722,120, (d) Japanese Pat. Nos. 43-223, 2132-116, 3017-692, and 3021-293, (e) U.S. Pat. Nos. 3,991,013; 3,991,014; 4,057,597; 4,066,620; 4,075,262; 4,118,372; 4,146,702; 4,153,779; 4,156,070; 4,159,365; 4,169,933; 4,181,792; 4,188,476; 4,226,970; 4,201,856; 4,232,143; 4,232,144; 4,245,082; and 4,238,600; and (f) U. K. Application No. 2,002,404.

Wholly aromatic polymers which are preferred for use in the present invention include wholly aromatic polyesters and poly(ester-amide)s which are disclosed in commonly-assigned U.S. Pat. Nos. 4,067,852; 4,083,829; 4,130,545; 4,161,470; 4,184,996; 4,219,461; 4,230,817; 4,238,598; 4,238,599; 4,244,433; 4,256,624; 4,279,803; 4,299,756; 4,330,457; 4,339,375; 4,341,688; 4,351,917; 4,351,918; and 4,355,132. The disclosures of all of the above-identified commonly-assigned U.S. patents and applications are herein incorporated by reference in their entirety. The wholly aromatic polyesters and poly(ester-amide)s disclosed therein typically are capable of forming an anisotropic melt phase at a temperature below approximately 400° C., and preferably below approximately 350° C.

The thermotropic liquid crystal polymers including wholly aromatic polyesters and poly(ester-amide)s which are suitable for use in the present invention may be formed by a variety of ester-forming techniques whereby organic monomer compounds possessing functional groups which, upon condensation, form the requisite recurring moieties are reacted. For instance, the functional groups of the organic monomer compounds may be carboxylic acid groups, hydroxyl groups, ester groups, acyloxy groups, acid halides, amine groups, etc. The organic monomer compounds may be reacted in the absence of a heat exchange fluid via a melt acidolysis procedure. They, accordingly, may be heated initially to form a melt solution of the reactants with the reaction continuing as said polymer particles are suspended therein. A vacuum may be applied to facilitate removal of volatiles formed during the final stage of the condensation (e.g., acetic acid or water).

Commonly-assigned U.S. Pat. No. 4,083,829, entitled "Melt Processable Thermotropic Wholly Aromatic Polyester," describes a slurry polymerization process which may be employed to form the wholly aromatic polyesters which are preferred for use in the present invention. According to such a process, the solid product is suspended in a heat exchange medium. The disclosure of this patent has previously been incorporated herein by reference in its entirety. Although that patent is directed to the preparation of wholly aromatic polyesters, the process may also be employed to form poly(ester-amide)s.

When employing either the melt acidolysis procedure or the slurry procedure of U.S. Pat. No. 4,083,829, the organic monomer reactants from which the wholly aromatic polyesters are derived may be initially provided in a modified form whereby the usual hydroxy groups of such monomers are esterified (i.e., they are provided as lower acyl esters). The lower acyl groups preferably have from about two to about four carbon atoms. Preferably, the acetate esters of organic monomer reactants are provided. When poly(ester-amide)s are to be formed, an amine group may be provided as a lower acyl amide.

Representative catalysts which optionally may be employed in either the melt acidolysis procedure or in the slurry procedure of U.S. Pat. No. 4,083,829 include dialkyl tin oxide (e.g., dibutyl tin oxide), diaryl tin oxide, titanium dioxide, antimony trioxide, alkoxy titanium silicates, titanium alkoxides, alkali and alkaline earth metal salts of carboxylic acids (e.g., zinc acetate), the gaseous acid catalysts such as Lewis acids (e.g., $BF_3$), hydrogen halides (e.g., HCl), etc. The quantity of catalyst utilized typically is about 0.001 to 1 percent by weight based upon the total monomer weight, and most commonly about 0.01 to 0.2 percent by weight.

The wholly aromatic polyesters and poly(ester-amide)s suitable for use in the present invention tend to be substantially insoluble in common polyester solvents and accordingly are not susceptible to solution processing. As discussed previously, they can be readily processed by common melt processing techniques. Most suitable wholly aromatic polymers are soluble in pentafluorophenol to a limited extent.

The wholly aromatic polyesters which are preferred for use in the present invention commonly exhibit a weight average molecular weight of about 2,000 to 200,000, and preferably about 10,000 to 50,000, and most preferably about 20,000 to 25,000. The wholly aromatic poly(ester-amide)s which are preferred for use in the present invention commonly exhibit a molecular weight of about 5,000 to 50,000, and preferably about 10,000 to 30,000; e.g., 15,000 to 17,000. Such molecular weight may be determined by gel permeation chromatography and other standard techniques not involving the solutioning of the polymer, e.g., by end group determination via infrared spectroscopy on compression molded films. Alternatively, light scattering techniques in a pentafluorophenol solution may be employed to determine the molecular weight.

The wholly aromatic polyesters and poly(ester-amide)s additionally commonly exhibit an inherent viscosity (i.e., I.V.) of at least approximately 2.0 dl./g., e.g., approximately 2.0 to 10.0 dl./g., when dissolved in a concentration of 0.1 percent by weight in pentafluorophenol at 60° C.

For the purposes of the present invention, the aromatic rings which are included in the polymer backbones of the polymer components may include substitution of at least some of the hydrogen atoms present upon an aromatic ring. Such substituents include alkyl groups of up to four carbon atoms; alkoxy groups having up to four carbon atoms; halogens; and additional aromatic rings, such as phenyl and substituted phenyl. Preferred halogens include fluorine, chlorine and bromine. Although bromine atoms tend to be released from organic compounds at high temperatures, bromine is more stable on aromatic rings than on aliphatic chains, and therefore is suitable for inclusion as a possible substituent on the aromatic rings.

Especially preferred wholly aromatic polyesters and poly(ester-amide)s are those which are disclosed in above-noted U.S. Pat. Nos. 4,161,470, 4,184,996, 4,219,461, 4,256,624, 4,238,599 and 4,330,457.

The wholly aromatic polyester which is disclosed in U.S. Pat. No. 4,161,470 is a melt processable wholly aromatic polyester capable of forming in anisotropic melt phase at a temperature below approximately 350° C. The polyester consists essentially of the recurring moieties I and II wherein:

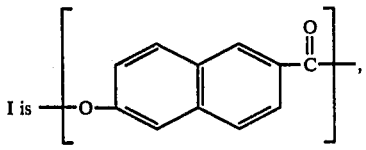

and

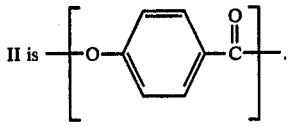

The polyester comprises approximately 10 to 90 mole percent of moiety I, and approximately 10 to 90 mole percent of moiety II. In one embodiment, moiety II is present in a concentration of approximately 65 to 85 mole percent, and preferably in a concentration of approximately 70 to 80 mole percent, e.g., approximately 75 mole percent. In another embodiment, moiety II is present in a lesser proportion of approximately 15 to 35 mole percent, and preferably in a concentration of approximately 20 to 30 mole percent. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

The wholly aromatic polyester which is disclosed in U.S. Pat. No. 4,184,996 is a melt processable wholly aromatic polyester capable of forming an anisotropic melt phase at a temperature below approximately 325° C. The polyester consists essentially of the recurring moieties I, II and III wherein:

I is 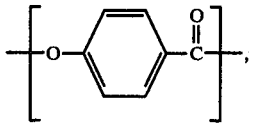 ,

II is 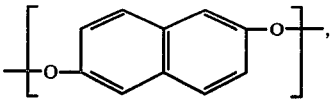 , and

III is 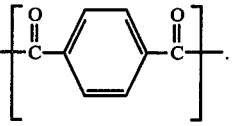 .

The polyester comprises approximately 30 to 70 mole percent of the moiety I. The polyester preferably comprises approximately 40 to 60 mole percent of moiety I, approximately 20 to 30 mole percent of moiety II, and approximately 20 to 30 mole percent of moiety III. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

The wholly aromatic polyester which is disclosed in U.S. Pat. No. 4,238,599 is a melt processable polyester capable of forming an anisotropic melt phase at a temperature no higher than approximately 320° C. consisting essentially of the recurring moieties I, II, III and IV wherein:

I is 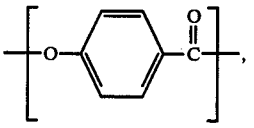 ,

II is 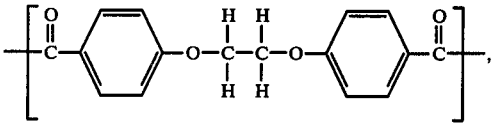 ,

III is 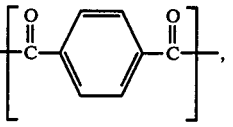 , and

IV is 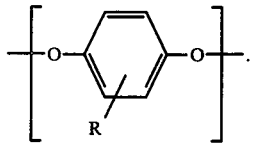 .

where R is methyl, chloro, bromo, or mixtures thereof, and is substituted for a hydrogen atom present upon the aromatic ring, and wherein said polyester comprises approximately 20 to 60 mole percent of moiety I, approximately 5 to 18 mole percent of moiety II, approximately 5 to 35 mole percent of moiety III, and approximately 20 to 40 mole percent of moiety IV. The polyester prefereably comprises approximately 35 to 45 mole percent of moiety I, approximately 10 to 15 mole percent of moiety II, approximately 15 to 25 mole percent of moiety III, and approximately 25 to 35 mole percent of moiety IV, with the proviso that the total molar concentration of moieties II and III is substantially identical to that of moiety IV. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof. This wholly aromatic polyester commonly exhibits an inherent viscosity of at least 2.0 dl./g., e.g., 2.0 to 10.0 dl./g., when dissolved in a concentration of 0.1 weight/volume percent in pentafluorophenol at 60° C.

The polyester disclosed in U.S. Pat. No. 4,219,461 is a melt processable wholly aromatic polyester which is capable of forming an anisotropic melt phase at a temperature below approximately 320° C. The polyester consists essentially of the recurring moieties I, II, III, and IV wherein:

I is 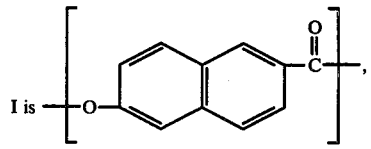 ,

II is 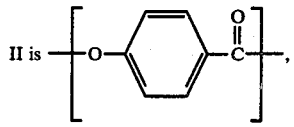 ,

III is a dioxy aryl moiety of the formula $\text{+O—Ar—O+}$ wherein Ar is a divalent radical comprising at least one aromatic ring, and IV is a dicarboxy aryl moiety of the formula $\text{+C(=O)—Ar'—C(=O)+}$ where Ar' is a divalent radical comprising at least one aromatic ring, and wherein the polyester comprises approximately 20 to 40 mole percent of moiety I, in excess of 10 up to about 50 mole percent of moiety II, in excess of 5 up to about 30 mole percent of moiety III, and in excess of 5 up to about 30 mole percent of moiety IV. The polyester preferably comprises approximately 20 to 30 (e.g., approximately 25) mole percent of moiety I, approximately 25 to 40 (e.g., approximately 35) mole percent of moiety II, and approximately 15 to 25 (e.g., approximately 20) mole percent of moiety III and approximately 15 to 25 (e.g., approximately 20) mole percent of moiety IV. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

Moieties III and IV are preferably symmetrical in the sense that the divalent bonds which join these moieties to other moieties in the main polymer chain are symmetrically disposed on one or more aromatic rings (e.g., are para to each other or diagonally disposed when present on a naphthalene ring). However, non-symmetrical moieties, such as those derived from resorcinol and isophthalic acid, may also be used.

Preferred moieties III and IV are set forth in above-noted U.S. Pat. No. 4,219,461. The preferred dioxy aryl moiety III is:

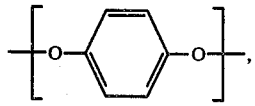

and the preferred dicarboxy aryl moiety IV is:

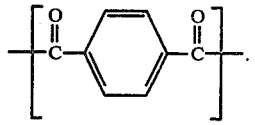

The polyester disclosed in U.S. Pat. No. 4,256,624 is a melt processable wholly aromatic polyester which is capable of forming an anisotropic melt phase at a temperature below approximately 400° C. The polyester consists essentially of the recurring moieties I, II, and III wherein:

I is 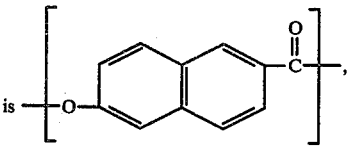

II is a dioxy aryl moiety of the formula $\text{+O—Ar—O+}$ where Ar is a divalent radical comprising at least one aromatic ring, and III is a dicarboxy aryl moiety of the formula $\text{+}\overset{\text{O}}{\overset{\|}{\text{C}}}\text{—Ar'—}\overset{\text{O}}{\overset{\|}{\text{C}}}\text{+}$ where Ar' is a divalent radical comprising at least one aromatic ring, and wherein the polyester comprises approximately 10 to 90 mole percent of moiety I, approximately 5 to 45 mole percent of moiety II, and approximately 5 to 45 mole percent of moiety III. The polyester preferably comprises approximately 20 to 80 mole percent of moiety I, approximately 10 to 40 mole percent of moiety II, and approximately 10 to 40 mole percent of moiety III. The polyester more preferably comprises approximately 60 to 80 mole percent of moiety I, approximately 10 to 20 mole percent of moiety II, and approximately 10 to 20 mole percent of moiety III. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

As with moieties III and IV of the polyester disclosed in U.S. Pat. No. 4,219,461, moieties II and III of the polyester described immediately above may be symmetrical or nonsymmetrical, but are preferably symmetrical.

Preferred moieties II and III ar set forth in above-noted U.S. Pat. No. 4,256,624. The preferred dioxy aryl moiety II is:

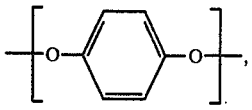

and the preferred dicarboxy aryl moiety III is:

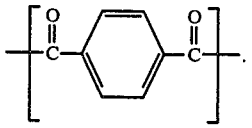

U.S. Pat. No. 4,330,457 discloses a melt processable poly(ester-amide) which is capable of forming an anisotropic melt phase at a temperature below approximately 400° C. The poly(ester-amide) consists essentially of the recurring moieties I, II, III and optionally IV wherein:

I is 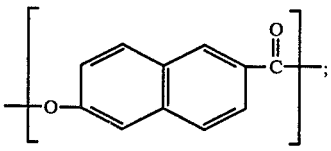

II is $\text{+}\overset{\text{O}}{\overset{\|}{\text{C}}}\text{—A—}\overset{\text{O}}{\overset{\|}{\text{C}}}\text{+}$, where A is a divalent radical comprising at least one aromatic ring or a divalent transcyclohexane radical, III is $\text{+Y—Ar—Z+}$, where Ar is a divalent radical comprising at least one aromatic ring, Y is O, NH, or NR, and Z is NH or NR, where R is an alkyl group of 1 to 6 carbon atoms or an aryl group; and IV is $\text{+O—Ar'—O+}$, where Ar' is a divalent radical comprising at least one aromatic ring;

and wherein said poly(ester-amide) comprises approximately 10 to 90 mole percent of moiety I, approximately 5 to 45 mole percent of moiety II, approximately 5 to 45 mole percent of moiety III, and approximately 0 to 40 mole percent of moiety IV. In addition, at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

Preferred moieties II, III and IV are set forth in above-noted U.S. Pat. No. 4,330,457. The preferred dicarboxy aryl moiety II is:

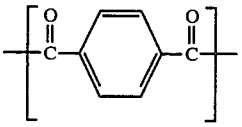

the preferred moiety III is:

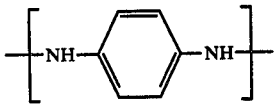

or

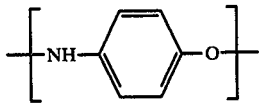

and the preferred dioxy aryl moiety IV is:

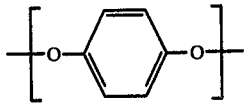

The fabric of the present invention is comprised of fibers of thermotropic liquid crystal polymers and infusible fibers. Infusible fibers suitable for use in the present invention include carbon fibers, glass fibers, asbestos fibers, boron fibers, alumina fibers, silicon carbide, borosilicatealumina fibers and lyotropic liquid crystal polymer fibers. Those infusible fibers which are preferred are carbon fibers and glass fibers This listing is not intended to be all-inclusive since one skilled in the art can readily determine which infusible fibers may be advantageously used in the fabric of the present invention.

The fabric of the present invention may be formed by any suitable method and may be woven, knitted or non-woven. Preferably, the thermotropic liquid crystal polymer fibers are utilized in a woven fabric. For example, the infusible fibers may be utilized as the warp in the woven fabric and the fusible fibers may utilized as the weft, or vice versa. It is also possible to mix fusible and infusible fibers in either or both of the warp and weft.

The fabric need not be woven per se but can also be constructed by layering the infusible and fusible fibers upon one another. Preferably, the respective types of fibers are placed in alternating layers such that a layer of fusible fibers is adjacent a layer of infusible fibers. See, for example, British Patent Nos. 1,228,573 and 1,260,409, herein both fully and completely incorporated by reference, wherein such an embodiment is disclosed, albeit not with fibers of liquid crystal polymers.

The fabric can also be provided by spray spinning a random web of fibers of a thermotropic liquid crystal polymer onto a layer of infusible fibers (e.g., a woven web of carbon fibers). In the alternative, melt spun fibers of a thermotropic liquid crystal polymer cut to appropriately short lengths can be slurried with a liquid which is a non-solvent for the polymer (e.g., water) and subsequently filtered onto a web of infusible fibers. It is also possible to provide a slurry of both fusible and infusible fibers which are then filtered onto a web or screen to form a random array of both fusible and infusible fibers.

The fibers can also be braided together or a sheet can be formed by filament winding by use of fusible and infusible fibers.

Upon being fabricated by appropriate means, the fabric is subjected to heat treatment to thermally bond the fusible thermotropic liquid crystal polymer fibers to adjacent and/or intersecting fibers. The extent of the bonding can vary depending upon the end use contemplated and the physical form desired for the fabric. That is, the fabric need only be heat treated sufficiently to bond the fusible fibers to the extent desired. The fabric may also be heat treated to a greater extent such that the thermotropic liquid crystal polymer fibers serve as a more coherent matrix-like structure for the infusible fibers. Such thermal bonding preferably occurs with the application of pressure in order to ensure that sufficient bonding of the fibers occurs.

The fabric of the present invention can be comprised of various proportions of the fusible and infusible fibers. For example, the fabric is preferably comprised of from about 5 to about 80 weight percent of infusible fibers and from about 20 to about 95 weight percent of thermotropic liquid crystal polymer fibers, and more preferably from about 40 to about 70 weight percent of infusible fibers and from about 30 to about 60 weight percent of thermotropic liquid polymer fibers.

The fabric possesses many advantageous characteristics due to the presence of thermotropic liquid crystal polymers therein. That is, since liquid crystal polymers are highly oriented as spun, the fibers which comprise the fabrics of the present invention possess relatively high tensile strength and modulus. Accordingly, fabrics comprised of such fibers similarly exhibit relatively high tenacity and modulus.

In addition, the fibers retain such tensile strength and modulus even upon being subjected to temperatures sufficient to melt the fibers due to the ability of the polymers to form an anisotropic melt phase. This is in direct contrast to conventional thermoplastic polymers which are not capable of forming an anisotropic melt and which lose their orientation upon being subjected to temperatures in excess of their melting temperature.

Typical thicknesses of the fabric range from 0.005 inch to 0.10 inch. In addition, reinforcement of the fabric in several directions is also possible by varying the direction of orientation of the fusible fibers (e.g., the fibers may be oriented at 0, ±45 and 90° to one axis of the fabric).

The fabrics also benefit from other physical characteristics of thermotropic liquid crystal polymers such as resistance to chemical corrosion or solvation and high temperature stability due to the high melting temperatures of the fibers. Such fabrics thus are well suited for use in high temperature and/or otherwise destructive environments which would tend to degrade conventional fabrics.

The fabrics of the present invention can be employed as metal replacements where density and dynamic mechanical vibrations are factors. For instance, lighter weight aircraft/aerospace components can be made from the fabric. Moving parts for industrial equipment are also a suitable end use where the rate of motion is determined by fundamental part vibration characteristics.

The mechanical properties of the fabric produced in accordance with the present invention can be improved still further by subjecting the fabric to a heat treatment following formation thereof. The heat treatment improves the properties of the fabric by increasing the molecular weight of the liquid crystalline polymer which comprises certain of the fibers present within the fabric and increasing the degree of crystallinity thereof while also increasing the melting temperature of the polymer. Such heat treatment can also serve to bond the fibers together.

The fabric may be thermally treated in an inert atmosphere (e.g., nitrogen, carbon dioxide, argon, helium) or alternatively, in a flowing oxygen-containing atmosphere (e.g, air). The use of a non-oxidizing substantially moisture-free atmosphere is preferred to avoid the possibility of thermal degradation. For instance, the fabric may be brought to a temperature approximately 10 to 30 centigrade degrees below the melting temperature of the liquid crystal polymer, at which temperature the fibers remain a solid object. It is preferable for the temperature of the heat treatment to be as high as possible without equaling or exceeding the melting temperature of the polymer. It is most preferable to gradually increase the temperature of heat treatment in accordance with the increase of the melting temperature of the polymer during heat treatment.

The duration of the heat treatment will commonly range from a few minutes to a number of days, e.g., from 0.5 to 200 hours, or more. Preferably, the heat treatment is conducted for a time of 1 to 48 hours and typically from about 5 to 30 hours.

Generally, the duration of heat treatment varies depending upon the heat treatment temperature; that is, a shorter treatment time is required as a higher treatment temperature is used. Thus, the duration of the heat treatment can be shortened for higher melting polymers, since higher heat treatment temperatures can be applied without melting the polymer.

Preferably, the heat treatment is conducted under conditions sufficient to increase the melting temperature of the polymer at least 10 centigrade degrees. Most preferably, the melting temperature of the liquid crystal polymer is increased from between about 20 to about 50 centigrade degrees as a result of the heat treatment. The amount of increase which is obtained is dependent upon the temperature used in the heat treatment, with higher heat treatment temperatures giving greater increases.

It should be noted at this time that reference herein to a temperature below which a specific polymer may exhibit anisotropic properties in the melt phase is intended to refer to the temperature below which the polymer exhibits such properties prior to any heat treatment thereof.

The chemical resistance of the polymer also increases with heat treatment and the solubility into pentafluorophenol, one of the rare solvents for thermotropic liquid crystal polymers, continuously decreases with increasing heat treatment time and eventually the material will not dissolve even minimally (such as in amounts of 0.1 percent by weight).

The invention is additionally illustrated in connection with the following Examples which are to be considered as illustrative of the present invention. It should be understood, however, that the invention is not limited to the specific details of the Examples.

EXAMPLE 1

Several linear yards of a plain weave fabric containing 12½ ends per inch of 3000 filament carbon fiber yarn marketed by Union Carbide under the tradename Thornel T-300 in the warp direction and 12½ ends per inch of 3000 denier liquid crystal polymer yarn in the weft direction are woven. The liquid crystal polymer is comprised of 27 mole percent of a 6-oxy-2-naphthoyl moiety and 73 mole percent of a p-oxy benzoyl moiety. The resulting fabric comprises approximately 33 volume percent carbon fiber and 67 volume percent of the liquid crystal polymer in filament form at approximately 6 denier per filament.

Four sections of the above fabric of 3×10 inches in dimension with the carbon fiber in the long direction are cut and stacked. The stacked sections of fabric are placed in a metal die mold of similar dimensions which is then placed in a heated press at 288° C. The press platens are brought into contact with the outer faces of the mold to enhance heat transfer to the mold. The mold is transferred to a water cooled press at ambient temperature after 45 minutes at 288° C. A pressure of 100 psi is applied to the stacked fabric in the mold and maintained for 30 minutes while the mold temperature is reduced to near ambient by the passage of cooling water through the press platens.

The laminated fabric thus formed is removed from the mold and determined to have a thickness of 0.026 inch. The laminate is relatively well compacted and exhibits no evidence of individual filaments of the liquid crystalline polymer. The filaments are completely fused and reformed to form a matrix for the carbon fiber yarn which exhibits minimal porosity. Tensile bars 8½ inches long in the carbon fiber direction and ½ inch wide are cut from the laminate. Tabs composed of fiberglass-reinforced epoxy 2¼ inch×½ inch in dimension are attached to the ends of both faces by use of a commercial cyanoacrylate adhesive to protect the ends of the tensile bars from being crushed in the transverse direction during testing. These specimens are tested in an Instron test machine whereby they are determined to exhibit the following tensile properties by use of ASTM test method 1D3039:

| Tensile Strength (psi) | Tensile Modulus (psi) | Failure Elongation (%) |
|---|---|---|
| 111,000 | $10.4 \times 10^6$ | 1.1 |

EXAMPLE 2

Fifteen sections or plies of a fabric produced in accordance with Example 1 are placed in a mold of dimensions 3×10 inches with the carbon fibers oriented in the long direction. A laminate is prepared by maintaining the mold at 288° C. with contact pressure for 2 hours. The laminate is held in a water-cooled press for 1 hour at 200 psi, whereby a laminate of 0.095 inch thickness is prepared containing 34 volume percent of carbon fiber. The short beam shear strength is measured using ASTM test method D2344 with a 4:1 span-to-depth ratio and determined to be 6500 psi.

EXAMPLE 3

Twelve sections or plies of a fabric prepared as in Example 1 are stacked in a 3×10 inch mold with the carbon fiber oriented in the long direction. A laminate is prepared by placing the mold and the charge in a heated press at 177° C. for 30 minutes under a pressure of 50 psi. The laminate is transferred to a water-cooled press and held under a pressure of 300 psi for 15 minutes. The laminate is removed and determined to have a thickness of 0.078 inches and a carbon fiber content of 34 volume percent. Flexural specimens of 4 inch lengths and ¼ inch widths are cut from the laminate. The mechanical properties of the specimens are measured by ASTM Test Method D790 at a 32:1 span-to-depth ratio and the properties determined as follows:

| Flexural Strength (psi) | Flexural Modulus (psi) |
|---|---|
| 99,500 | $8.8 \times 10^6$ |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A fabric which exhibits thermal stability and chemical and solvent resistance comprised of fusible and infusible fibers, said fusible fibers being thermally bonded to said infusible fibers and comprised of a polymer which is capable of forming an anisotropic melt phase.

2. The fabric of claim 1 wherein said polymer is a wholly aromatic polymer.

3. The fabric of claim 1 wherein said polymer is a wholly aromatic polyester.

4. The fabric of claim 1 wherein said polymer exhibits an inherent viscosity of at least 2.0 dl./g. when dissolved in a concentration of 0.1 percent by weight in pentafluorophenol at 60° C.

5. The fabric of claim 1 wherein said polymer comprises not less than about 10 mole percent of recurring units which include a naphthalene moiety.

6. The fabric of claim 5 wherein said naphthalene moiety of said wholly aromatic polymer is selected from the group consisting of a 6-oxy-2-naphthoyl moiety, a 2,6-dioxynaphthalene moiety, and a 2,6-dicarboxynaphthalene moiety.

7. The fabric of claim 1 wherein said polymer is capable of forming an anisotropic melt phase at a temperature below approximately 400° C.

8. The fabric of claim 1 wherein said polymer comprises a melt processable wholly aromatic polyester which is capable of forming an anisotropic melt phase and consists essentially of the recurring moieties I, II, and III wherein:

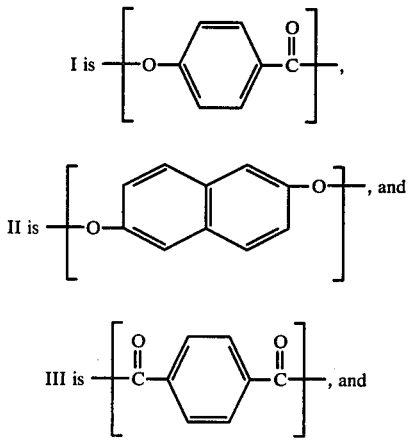

wherein said polyester comprises approximately 30 to 70 mole percent of moiety I and wherein at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

9. The fabric of claim 8 wherein said polyester comprises approximately 40 to 60 mole percent of moiety I, approximately 20 to 30 mole percent of moiety II, and approximately 20 to 30 mole percent of moiety III.

10. The fabric of claim 1 wherein said polymer comprises a melt processable wholly aromatic polyester which is capable of forming a anisotropic melt phase and consists essentially of the recurring moieties I and II wherein:

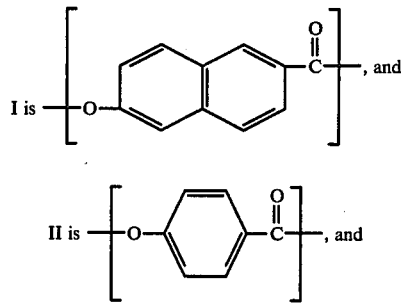

wherein said polyester comprises approximately 10 to 90 mole percent of moiety I, and approximately 10 to 90 mole percent of moiety II and wherein at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

11. The fabric of claim 10 wherein said polyester comprises approximately 65 to 85 mole percent of moiety II.

12. The fabric of claim 10 wherein said polyester comprises approximately 15 to 35 mole percent of moiety II.

13. The fabric of claim 1 wherein said polymer comprises a melt processable wholly aromatic polyester which is capable of forming an anisotropic melt phase and consists essentially of the recurring moieties I, II, and III wherein:

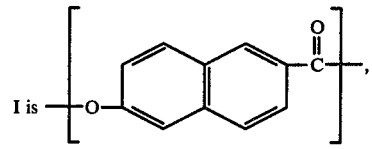

II is a dioxy aryl moiety of the formula $\text{+O—Ar—O+}$ where Ar is a divalent radical comprising at least one aromatic ring, and III is a dicarboxy aryl moiety of the formula $\text{+C(=O)—Ar'—C(=O)+}$ where Ar' is a divalent radical comprising at least one aromatic ring, and wherein said polyester comprises approximately 10 to 90 mole percent of moiety I, approximately 5 to 45 mole percent of moiety II, and approximately 5 to 45 mole percent of moiety III and wherein at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

14. The fabric of claim 13 wherein said polyester comprises approximately 20 to 80 mole percent of moiety I, approximately 10 to 40 mole percent of moiety II, and approximately 10 to 40 mole percent of moiety III.

15. The fabric of claim 1 wherein said polymer comprises a melt processable wholly aromatic polyester which is capable of forming an anisotropic melt phase and consists essentially of the recurring moieties I, II, III and IV wherein:

I is 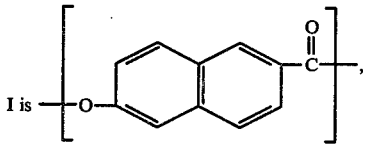 ,

II is 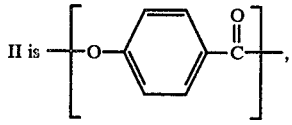 ,

III is a dioxy aryl moiety of the formula $\text{+O—Ar—O+}$ wherein Ar is a divalent radical comprising at least one aromatic ring, and IV is a dicarboxy aryl moiety of the formula $\text{+}\overset{O}{\overset{\|}{C}}\text{—Ar'—}\overset{O}{\overset{\|}{C}}\text{+}$ where Ar' is a divalent radical comprising at least one aromatic ring, and wherein the polyester comprises approximately 20 to 40 mole percent of moiety I, in excess of 10 up to about 50 mole percent of moiety II, in excess of 5 up to about 30 mole percent of moiety III, and in excess of 5 up to about 30 mole percent of moiety IV and wherein at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

16. The fabric of claim 15 wherein said polyester comprises approximately 20 to 30 mole percent of moiety I, approximately 25 to 40 mole percent of moiety II, approximately 15 to 25 mole percent of moiety III and approximately 15 to 25 mole percent of moiety IV.

17. The fabric of claim 1 wherein said polymer comprises a melt processable poly(ester-amide) which is capable of forming an anisotropic melt phase and consists essentially of the recurring moieties I, II, III and optionally IV wherein:

I is 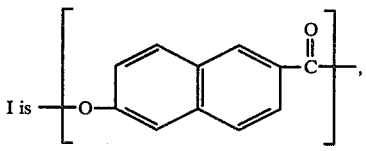 ,

-continued

II is $\text{+}\overset{O}{\overset{\|}{C}}\text{—A—}\overset{O}{\overset{\|}{C}}\text{+}$, where A is a divalent radical comprising at least one aromatic ring or a divalent transcyclohexane radical;

III is $\text{+Y—Ar—Z+}$, where Ar is a divalent radical comprising at least one aromatic ring, Y is O, NH or NR, and Z is NH or NR, where R is an alkyl group of 1 to 6 carbon atoms or an aryl group; and IV is $\text{+O—Ar'—O+}$, where Ar' is a divalent radical comprising at least one aromatic ring;

and wherein said poly(ester-amide) comprises approximately 10 to 90 mole percent of moiety I, approximately 5 to 45 mole percent of moiety II, approximately 5 to 45 mole percent of moiety III, and approximately 0 to 40 mole percent of moiety IV and wherein at least some of the hydrogen atoms present upon the rings optionally may be replaced by substitution selected from the group consisting of an alkyl group of 1 to 4 carbon atoms, an alkoxy group of 1 to 4 carbon atoms, halogen, phenyl, substituted phenyl, and mixtures thereof.

18. The fabric of claim 1 wherein said polymer has been subjected to a heat treatment for a period of time and at a temperature sufficient to increase the melting temperature of the polymer between about 20 to 50 centigrade degrees.

19. The fabric of claim 18 wherein said polymer has been subjected to a heat treatment after formation of said fabric.

20. The fabric of claim 18 wherein said heat treatment temperature ranges from about 10 to about 30 centigrade degrees below the melting temperature of the polymer.

21. The fabric of claim 20 wherein said period of time ranges from about 0.5 to about 200 hours.

22. The fabric of claim 21 wherein said period of time ranges from about 1 to about 48 hours.

23. The fabric of claim 22 wherein said period of time ranges from about 5 to about 30 hours.

24. The fabric of claim 18 wherein said heat treatment occurs in a non-oxidizing atmosphere.

25. The fabric of claim 24 wherein said atmosphere is substantially moisture-free.

26. The fabric of claim 24 wherein said heat treatment occurs in a nitrogen atmosphere.

27. The fabric of claim 1 which is in the form of a sheet.

28. The fabric of claim 1 wherein said infusible fibers are in the form of a woven web of said fibers.

29. The fabric of claim 1 wherein said infusible and fusible fibers are woven together to form said fabric.

30. The fabric of claim 1 wherein said fabric is formed by spray spinning said fusible fibers onto a web of infusible fibers and thermally bonding said fusible fibers to said infusible fibers.

31. The fabric of claim 1 wherein said fabric is formed by filtering a slurry of fusible and infusible fibers onto a web or screen and thermally bonding said fusible fibers to said infusible fibers.

32. The fabric of claim 1 wherein said infusible fibers are selected from the group consisting of carbon fibers, glass fibers and asbestos fibers.

33. The fabric of claim 32 wherein said infusible fibers are carbon fibers.

34. The fabric of claim 1 comprised of from about 5 to about 80 weight percent of infusible fibers and between about 95 to about 20 weight percent of fusible fibers.

* * * * *